US008186925B2

(12) United States Patent
Littlely

(10) Patent No.: US 8,186,925 B2
(45) **Date of Patent: *May 29, 2012**

(54) DRILL ROD HANDLER

(75) Inventor: Keith William Littlely, Perth (AU)

(73) Assignee: Longyear TM, Inc., South Jordan, UT (US)

( * ) Notice: Subject to any disclaimer, the term of this patent is extended or adjusted under 35 U.S.C. 154(b) by 552 days.

This patent is subject to a terminal disclaimer.

(21) Appl. No.: 12/297,038

(22) PCT Filed: Apr. 11, 2007

(86) PCT No.: PCT/AU2007/000476

§ 371 (c)(1),
(2), (4) Date: Sep. 24, 2009

(87) PCT Pub. No.: WO2007/115375

PCT Pub. Date: Oct. 18, 2007

(65) Prior Publication Data

US 2010/0021271 A1 Jan. 28, 2010

(30) Foreign Application Priority Data

Apr. 11, 2006 (AU) ..... 2006901901
Jul. 20, 2006 (AU) ..... 2006903908

(51) Int. Cl.
*E21B 19/00* (2006.01)
*E21B 19/14* (2006.01)
*E21B 19/15* (2006.01)
*E21B 19/20* (2006.01)

(52) U.S. Cl. ..... 414/22.55; 414/735

(58) Field of Classification Search ..... 166/77.51, 166/77.52; 175/85; 414/22.51–22.56, 22.58, 414/22.62, 22.65, 22.69, 22.71, 23, 736, 414/745.1, 745.3–745.5, 745.8, 746.3, 746.5, 414/908, 910–911; 901/30, 39

See application file for complete search history.

(56) References Cited

U.S. PATENT DOCUMENTS 3,438,266 A 4/1969 Carow et al.

(Continued)

FOREIGN PATENT DOCUMENTS

CA 2648824 9/2009

(Continued)

OTHER PUBLICATIONS

International Search Report and Written Opinion dated Jan. 17, 2011 from PCT Application No. PCT/US2010/037069 filed Jun. 2, 2010 (6 pages).

(Continued)

*Primary Examiner* — Gregory Adams
(74) *Attorney, Agent, or Firm* — Ballard Spahr LLP

(57) ABSTRACT

An elongate item handling means comprising a base (11) adapted to be fixed to a fixture, an elongate member support (13) having a first axis, the elongate member support comprising an engagement means (19) adapted to engage an elongate item and support the elongate item such that it is parallel to the first axis and to move the elongate item into engagement with the elongate member support, wherein the elongate member support is supported from the base to be rotatable about a second axis which is transverse to the first axis whereby the elongate item when supported from the elongate member support can be moved between an upright position and a substantially horizontal position, the base being movable on the fixture between a first position located at a desired erect position of the elongate item and one or more positions clear of the first position, said elongate member support.

23 Claims, 8 Drawing Sheets

U.S. PATENT DOCUMENTS

| | | | | |
|---|---|---|---|---|
| 3,920,972 | A | | 11/1975 | Corwin, Jr. et al. |
| 4,042,123 | A | | 8/1977 | Sheldon et al. |
| 4,077,132 | A | | 3/1978 | Erickson |
| 4,113,033 | A | | 9/1978 | Lindblad |
| 4,547,109 | A | | 10/1985 | Young et al. |
| 4,601,000 | A | | 7/1986 | Montabert |
| 4,606,133 | A | | 8/1986 | Mills |
| 4,718,805 | A | | 1/1988 | Becker |
| 4,875,823 | A | | 10/1989 | Fuse et al. |
| 5,115,690 | A | | 5/1992 | Torii et al. |
| 5,423,390 | A | * | 6/1995 | Donnally et al. ..... 175/85 |
| 5,458,454 | A | | 10/1995 | Sorokan |
| 5,788,401 | A | | 8/1998 | Drenth |
| 5,789,890 | A | | 8/1998 | Genov et al. |
| 5,821,419 | A | | 10/1998 | Mader et al. |
| 5,941,324 | A | | 8/1999 | Bennett |
| 6,109,620 | A | | 8/2000 | Roberts et al. |
| 6,196,598 | B1 | | 3/2001 | Yao |
| 6,298,927 | B1 | | 10/2001 | Back |
| 6,634,443 | B1 | | 10/2003 | Paech et al. |
| 6,845,564 | B2 | | 1/2005 | Saigh et al. |
| 7,318,283 | B2 | | 1/2008 | Kurose et al. |
| 2006/0248960 | A1 | | 11/2006 | Liskow et al. |
| 2009/0238663 | A1 | | 9/2009 | Littlely |

FOREIGN PATENT DOCUMENTS

| | | | | |
|---|---|---|---|---|
| WO | WO98/55728 | A1 | | 12/1998 |
| WO | WO 9855728 | A1 | * | 12/1998 |
| WO | WO99/31346 | A1 | | 6/1999 |
| WO | WO00/65193 | A1 | | 11/2000 |
| WO | 2007115375 | A1 | | 10/2007 |

OTHER PUBLICATIONS

Office Action dated Oct. 25, 2010 from Canadian Application No. 2,648,824 filed Oct. 13, 2008 (2 pages).

Office Action dated Jun. 15, 2010 from Australian Application No. 2007236557 filed Apr. 11, 2007 (2 pages).

International Search Report and Written Opinion dated May 17, 2007 from PCT Application No. PCT/AU2007/000476 (7 pages).

U.S. Appl. No. 12/477,788, filed Jun. 3, 2009, Keith Littely.

Office Action dated Oct. 3, 2011 from U.S. Appl. No. 12/477,788, filed Jun. 3, 2009 (6 pages).

Office Action dated Nov. 1, 2011 from U.S. Appl. No. 12/477,788, filed Jun. 3, 2009 (10 pages).

Office Action dated Jan. 4, 2012 from U.S. Appl. No. 12/477,788, filed Jun. 3, 2009 (9 pages).

* cited by examiner

DRILL ROD HANDLER

FIELD OF THE INVENTION

The present invention relates to a handling means for elongate items such as lengths of drill rods, poles, pipes and the like.

Throughout the specification the term "drill rod" will be taken to include all forms of elongate members used in the drilling, installation and maintenance of bore holes and wells in the ground and will include rods, pipes, tubes and casings which are provided in lengths and are interconnected to be used in the borehole.

BACKGROUND

One particular application of the invention relates to an accessory which can be used with drill rigs which are to be used in drilling bore holes. Such drill rigs generally comprise an upstanding mast which has a drill head mounted to it where the drill head is capable of movement along the mast and the drill head is provided with means which can receive and engage the upper end of a drill string and can apply a rotational force to the drill string to cause it to rotate within the bore hole whereby such rotation results in the cutting action by the drill bit mounted to the lower end of the drill string. The drill string comprises a number of lengths of drill rod which are connected end to end and where the length of drill rod generally is at the most equal to the height of the mast. It is usual that each length of the length of drill rod can be up to a length of the order of six meters. During a drilling operation when the drill head has reached the lower end of the mast, the drill string is clampingly retained and the drill head is disconnected from the drill string. A fresh length of drill rod is then raised into position in order that the upper end of the fresh length is engaged to the drill head and the lower end of the fresh length is engaged with the upper end of the drill string. Once the fresh length of drill rod has been installed, the drilling operation can recommence until the drill head again reaches the lower end of the mast. During drilling activities of deep bore holes which may extend for hundreds of meters, it is necessary to locate fresh lengths of drill rod into a drill string at very regular intervals.

It is usual that the drill rig is mounted to the chassis of a motorised vehicle such as a truck or lorry and that the lengths of drill rod are mounted in a storage zone such that they lie horizontally in a stacked array beside the drilling mast on the same vehicle or alternatively on a vehicle parked alongside the drilling rig or on the ground beside the drilling rig.

The usual method for raising a fresh length of drill rod from the bin to the mast comprises mounting a holder along the length of the length of drill rod connecting that holder to a cable carried by a winch located at the upper end of the mast and then lifting the length of drill rod into position. This requires manipulation by a member of the drill rig crew who is required to support and guide the lowermost end of the length of drill rod as the length of drill rod is being raised into position. Due to the nature of drilling sites, this action can be quite hazardous. In addition, during the raising of the drilling drill rod, it has been known for the upper portion of the length of drill rod to strike some obstruction on the drill mast which causes the lower end to move in an unpredictable manner which can result in injury to the crew member. In addition, this process requires joint coordination between the crew member guiding the one end and the other crew member controlling the winch.

Similarly during the raising of a drill string, it becomes necessary to regularly remove lengths of drill rod from a drill string and locate those lengths in the storage zone located beside the mast which may be either located on the same vehicle as the drilling rig or oh some adjacent vehicle or on the ground beside the drilling rig. This can also create hazards for the personnel required to handle and store the lengths of drill rod.

In the past alternative arrangements have been proposed for the handling of drill rods and examples of such are described in AU693382 and U.S. Pat. No. 6,298,927.

The discussion throughout this specification, of the background and prior art to the invention is intended only to facilitate an understanding of the present invention. It should be appreciated that the discussion is not an acknowledgement or admission that any of the material referred to was part of the common general knowledge in Australia or the world as at the priority date of the application.

It is an object of this invention to provide a means of supporting and handling elongate item such as lengths of drill rod between the storage area for those items and the erect position which can reduce the likelihood of injury to personnel.

It is also an object of the invention to improve the efficiency of drill rod handling.

DISCLOSURE OF THE INVENTION

Throughout the specification and claims, unless the context requires otherwise, the word "comprise" or variations such as "comprises" or "comprising", will be understood to imply the inclusion of a stated integer or group of integers but not the exclusion of any other integer or group of integers.

According to one aspect the invention resides in a handler for an elongate item, comprising: an arm which is adapted to be supported at one end, the other end of the arm providing an elongate member support for receiving an elongate item and moving it axially from a first position along a first axis which is parallel to the elongate item into engagement with the elongate member support; the elongate member support being rotatable on the radial arm about a second axis which is transverse to the first axis to enable the elongate item to be moved to an erect position; and the one end of the arm being mounted to enable movement of the elongate member about a third axis into a second position.

According to another aspect the invention resides in an elongate item handling means comprising a base adapted to be fixed to a fixture, an elongate member support having a first axis, the elongate member support comprising an engagement means adapted to engage an elongate item and support the elongate item such that it is parallel to the first axis and to move the elongate item into engagement with the elongate member support, wherein the elongate member support is supported from the base to be rotatable about a second axis which is transverse to the first axis whereby the elongate item when supported from the elongate member support can be moved between an upright position and a substantially horizontal position, the base being movable on the fixture between a first position located at a desired erect position of the elongate item and one or more positions clear of the first position, said elongate member support.

According to a preferred feature of the invention the fixture comprises a drilling rig having a drilling mast which is associated with a drill string located in a borehole and the elongate item comprises a length of drill rod and wherein the upright axis is substantially parallel to the axis of the drill string.

According to another aspect the invention resides in a drill rod handling means which in use is intended to be mounted to a drill rig adjacent a drilling mast which is associated with a drill string located in a borehole, the handling means comprising a base adapted to be supported from the drill rig and an elongate member support having a first axis and having an engagement means which is adapted to engage a length of drill rod such that the length of drill rod is parallel to the first axis and to move the length of drill rod longitudinally into and out of engagement with the elongate member support, the elongate member support being supported from the base to be rotatable about a second axis transverse to the first axis whereby a length of drill rod when supported from the elongate member support can be moved between an upright position and a substantially horizontal position, wherein the upright axis is substantially parallel to the axis of the drill string, the base being movable relative to the drill rig when the length of drill rod is in the erect position between a first position at which the length of drill rod is in substantial alignment with the drill string and one or more positions clear of the first position.

According to another aspect the invention resides in a drilling system comprising a drilling mast which is to be associated with drill string located in a bore hole and a drill rod handling means which in use is intended to be mounted adjacent the drilling mast, the handling means comprising: a base adapted to be supported from the drill rig; and an elongate member support having a first axis and having an engagement means which is adapted to engage a length of drill rod such that the length of drill rod is parallel to the first axis and to move the length of drill rod longitudinally into and out of engagement with the elongate member support; the elongate member support being supported from the base to be rotatable about a second axis transverse to the first axis whereby a length of drill rod when supported from the elongate member support can be moved between an upright position and a substantially horizontal position; wherein the upright axis is substantially parallel to the axis of the drill string; the base being movable relative to the drilling mast when the length of drill rod is in the erect position between a first position at which the length of drill rod is in substantial alignment with the drill string and one or more positions clear of the first position.

According to a preferred feature of the invention the elongate member support comprises a set of clamp elements which are movable to be able to clampingly engage the length of drill rod and to be disengageable from the length of drill rod.

According to a preferred feature of the invention the elongate member support further comprises an elongate extension, the engagement means being mounted to the extension to be movable along the extension towards and away form the clamp elements to cause the movement of the elongate item into engagement with the elongate member support respectively.

An According to a preferred feature of the invention the engagement member includes a clamping means to enable the engagement member to clampingly engage the elongate item.

According to a preferred feature of the invention the elongate member support is rotatable on the base about the first axis and the central axis of the length of drill rod when engaged by the elongate member support is spaced from the first axis.

According to a further preferred feature of the invention, the base comprises a radial arm which supports the elongate member support towards one end and which adapted to be supported at its other end from the drill rig to be rotatable about a third axis which is substantially parallel to the drill string wherein the rotation of the radial arm about the third axis causes the movement of the length of drill rod between the first position and the one or more positions clear of the first position.

According to another aspect the invention resides in a method of installing lengths of a drill rod into a drill string associated with a drilling mast comprising providing a handler which engages a length of drill rod located beside the drilling mast by engaging the length of drill rod intermediate its length, moving the length of drill rod axially such that an end portion is engaged by an elongate member support, engaging the elongate member support with the lower end, rotating the length of drill rod about an axis which is transverse to the axis of the length of drill rod to an erect position which is substantially parallel to the drill string, moving the length of drill rod to a position at which it is aligned with the drill string and locating the length of drill rod into the drill string.

According to another aspect the invention resides in a method of removing a length of drill rod from a drill string associated with a drilling mast comprising providing a handler having an elongate member support which engages the uppermost length of drill rod of the drill string at a position towards the lower end of the length of drill rod, moving the length of drill rod to a position at which it is clear of the drill sting and is located adjacent a desired position for the length of drill rod, rotating the length of drill rod about an axis which is transverse to the axis of the length of drill rod to a substantially horizontal position beside the drilling mast, moving the length of drill rod axially out of engagement with the elongate member support and disengaging the length of drill rod form the handler.

The invention will be more fully understood in light of the following description of one specific embodiment.

BRIEF DESCRIPTION OF THE DRAWINGS

The description is made with reference to the accompanying drawings of which.

DETAILED DESCRIPTION OF SPECIFIC EMBODIMENT

Figure 1:
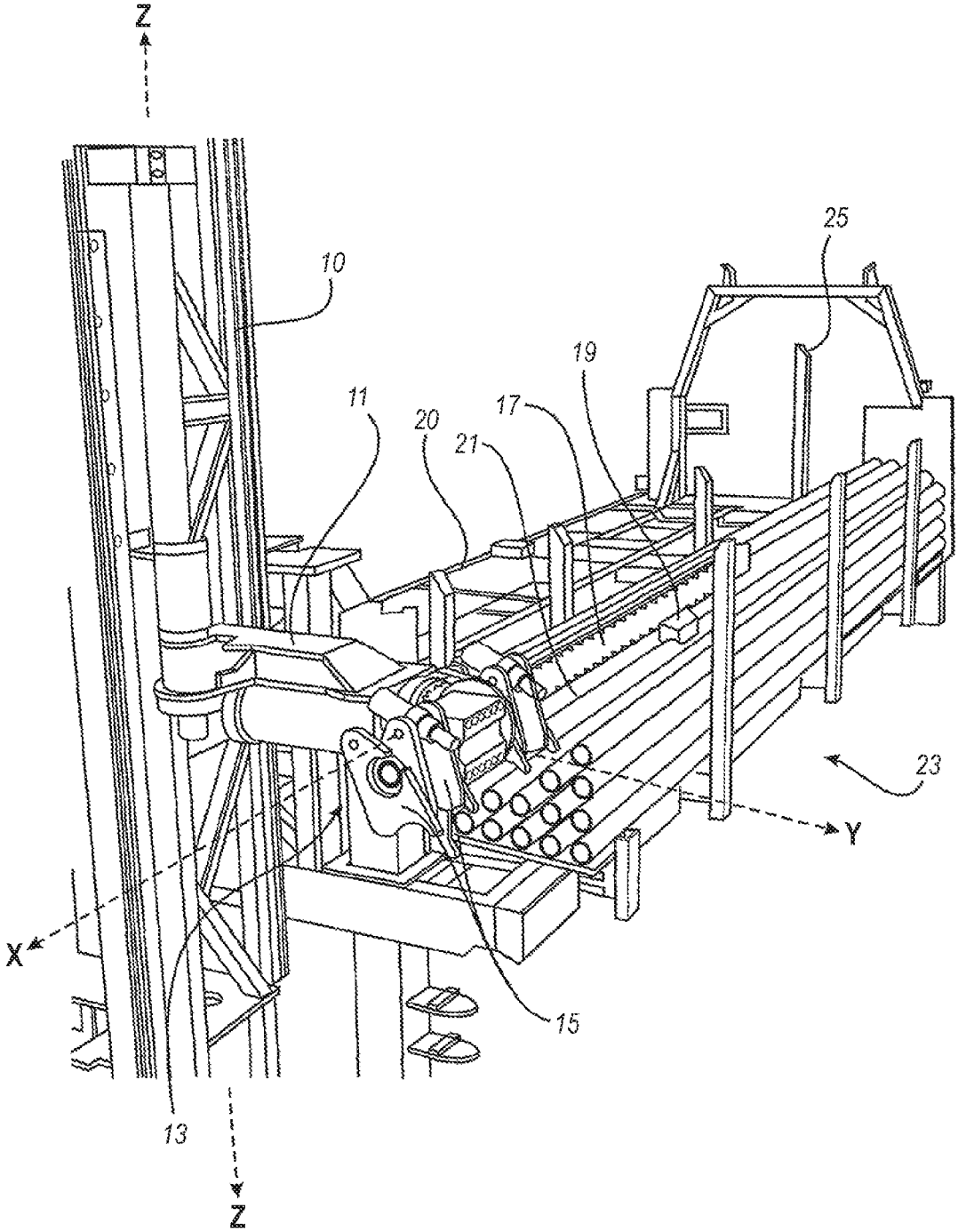
FIG. 1 is an isometric view of the rod handler according to the first embodiment associated with a drilling mast at the point in time when a rod has been initially engaged by the engaging means.

The embodiment is directed to a drill rod handling means which can be incorporated into a drill rig either as an attachment or as an integral part of the drill rig. Such drill rigs generally comprise an upstanding mast 10 which extends upwardly from a slips table 12 (see FIGS. 7 and 8) and which has a drive head (not shown) which is movable along the mast between a lower position adjacent the slips table and a raised position towards the free end of the mast. The mast is pivotable on its mounting about a transverse axis which is substantially contained within the plane of the slips table. The pivotal movement of the mast is controlled and enables the mast to adopt variety of erect positions which can include the horizontal or vertical position to enable a bore hole to be drilled at any desired angle.

The drilling rig is of the embodiment is intended to be typically mounted to a vehicle (not shown). In other embodiments, the drilling rig can be transported by a vehicle and then left in a stationary position when de-coupled from the vehicle. In yet other embodiments, the drill rig can be configured to be portable by itself, for example, in the same manner as a Mini Sonic® drilling rig.

The drill head is provided with means which can receive and engage the upper end of a drill string (not shown) and can apply a rotational force to the drill string to cause it to rotate within the bore hole whereby such rotation results in the cutting action by the drill bit mounted to the lower end of the drill string. In addition, the drill head may have means for applying a downward force to the drill string and is associated with a compressed air source to provide compressed air to the drill bit to facilitate penetration clearance of cuttings from the bore hole and the operation of fluid operated hammers that may be associated with the drill bit or string. As well, in some instances, the drill head can optionally apply vibrational energy for sonic drilling processes as known in the art.

The drill string comprises a number of lengths of drill rod 21 which are connected end to end and where the length of any individual drill rod is generally, at the most, equal to the height of the mast (e.g. approximately six meters). During a drilling operation when the drill head has reached the lower end of the mast, the drill string is retained to the mast and the drive head is disconnected from the drill string to be raised to the upper end of the mast. A fresh length of drill rod is then raised into position in order that the upper end of the next drill rod is engaged to the drill head and the lower end of the drill rod is free. The drill head then moves the next drill rod downward to engage the upper end of the drill string. Once the next drill rod has been installed, the drilling operation can recommence until the drill head again reaches the lower end of the mast. During drilling activities of deep bore holes which may extend for hundreds of meters, it is necessary to locate fresh lengths of drill rod into a drill string at very regular intervals. It is usual that the drill rig is provided with a storage zone 23 which can accommodate the lengths of drill rod which are to be used such that they lie horizontally in a stacked array beside the drilling mast on the same vehicle or alternatively on a vehicle parked alongside the drilling rig or on the ground beside the drilling rig.

In the past, the usual method for raising a fresh length of drill rod from the bin to the mast comprises mounting a holder to an intermediate position along the length of the length of drill rod connecting that holder to a cable carried by a winch located at the upper end of the mast and then lifting the length of drill rod into position. This requires extensive manual intervention by a member of the drill rig crew who is required to support and guide the lowermost end of the length of drill rod as the length of drill rod is being raised into position. In addition, this process requires joint coordination between the crew member guiding the one end and the other crew member controlling the winch. In the reverse process of removing the lengths of drill rod, similar amounts of manual labour are needed to control the combination of the drill rod and the winch cable. And sometimes during the raising of a drill string, it becomes necessary to regularly remove lengths of drill rod from the drill string and locate those lengths in a vertical storage rack located beside the mast which may be either located on the same vehicle as the drilling rig or on some adjacent vehicle or on the ground beside the drilling rig.

It is an object of the drill rod handling means according to the embodiments described herein to enable drill rods to be picked up from a storage zone 23 located in close proximity to the mast of the drill rig and delivered into position in alignment with the drill string located in the bore hole without the need of a crew member to manipulate and support the drill rod in its movement between the storage zone 23 and drill sting and without the use of a winch cable. The drill rod handling means according to the embodiments described herein provides that once the length of drill rod is in position the drive head which supports the upper end of the drill string can be engaged with the upper end of the length of drill rod to enable the length of drill rod to then be lowered into engagement with the upper end of the drill string.

The drill rod handling means according to the illustrated embodiment comprises a radial arm 11 and an elongate member support 13. The elongate member support 13 has a first axis X and an elongate extension 17. The elongate extension extends to one side of the elongate member support 13 and is substantially coincidental with the first axis X. The elongate member support member comprises a retaining mechanism, such as a pair of clamps 15, which can be spaced longitudinally along an axis parallel to the first axis and each clamp comprises a pair of clamping elements which are movable towards and away from each other such that they are to engage and retain the side walls of a length of drill rod and whereby when a length of drill rod is supported from the elongate member support 13 it is supported to be parallel to and spaced laterally form the first axis X.

The elongate member support 13 also includes an engagement member 19 which is slidably supported upon the extension member 17 to be movable in a direction parallel to the first axis X. The engagement member 19 comprises a further retaining mechanism, such as a clamp, which is operable to enable it to selectively engage and hold a length of drill rod.

The elongate member support 13 is mounted to one end of the radial arm 11 and the other end of the radial arm is mounted to or adjacent to the drill mast. The elongate member support is rotatable on the radial arm about a second axis Y which is transverse to the first axis and which comprises a longitudinal axis of the radial arm. The one end of the radial arm 11 is also capable of pivotal movement with respect to the drill rig about a third axis Z which is substantially parallel to the axis of the drill mast and thus the drill string. The range of pivotable movement of the radial arm about this third axis on the drill rig is approximately 270°.

A first powered drive is provided between the radial arm 11 and the elongate member support 13 to enable rotation of the member support 13 about the first axis and a second powered drive is provided between the radial arm 11 and the elongate member support 13 to cause rotation of the elongate member support 13 about the second axis while a third powered drive is provided to enable the rotation of the radial arm about the third axis. The powered drive can take any form of drive and can include hydraulic, pneumatic, electrical, mechanical or a like power source The drill rod handling means according to the embodiment is intended to engage lengths of drill rod 21 which are accommodated in the storage zone 23 which is located to one side of the drilling mast 10. The storage zone 23 may be accommodated upon the vehicle 20 supporting the drill rig or upon another vehicle 20 or supported upon the ground or any other suitable structure in close proximity to the drilling mast 10.

The storage zone 23 is defined by any known type of storage mechanism, such as a set of longitudinally spaced U-shaped members 25. The set of longitudinally spaced U-shaped members 25 are capable of rotation about an axis which is located below U-shaped members and which is parallel to the longitudinal axis of the lengths of rod accommodated within the storage zone and parallel to the first axis X when the elongate member support is located proximate the storage zone and the extension overlies the lengths of drill rod therein. The pivotable support enables the set of U-shaped members to be tipped to cause lengths of drill rod to be positioned ready for engagement with the elongate member support 13.

Figure 8:
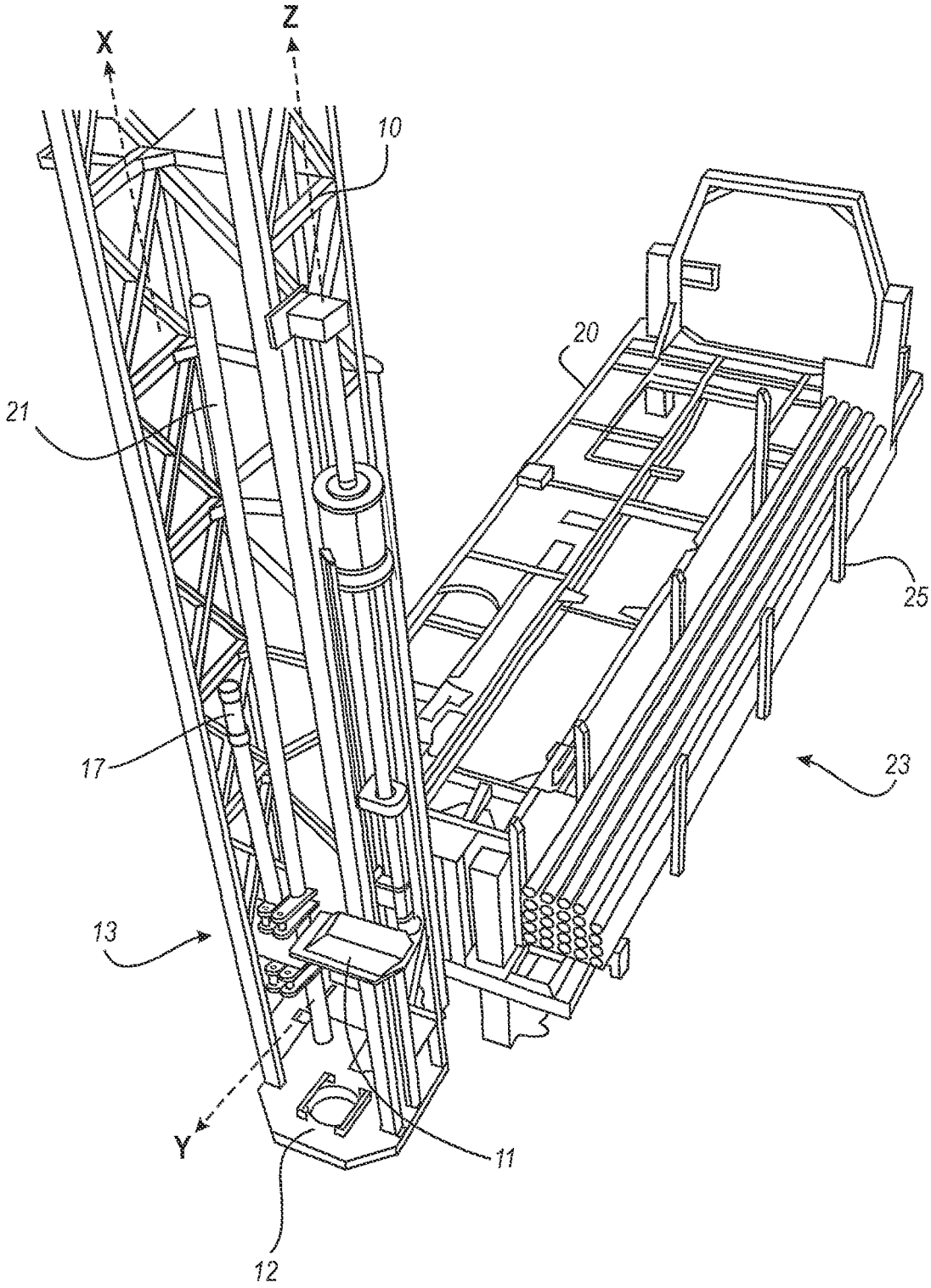
FIG. 8 is an isometric view corresponding to FIG. 7 illustrating the radial arm and drill rod in its final position on the drilling mast.

In operation, the drill rod handing means according to the illustrated embodiment is capable of engaging a length of drill rod 21 in the storage zone 23, locating the length of drill rod into the elongate member support 13, lifting the length of drill rod from the storage zone 23 and then moving it into position on the mast 10 such that it is in alignment with the drill string as shown at FIG. 8. To effect this action, the radial arm 11 is caused initially to rotate from a position close to the mast 10 about the third axis Z until that the elongate support lies adjacent one end of the lengths of drill rod located in the storage zone 23.

The elongate member support is then caused to rotate about the second axis Y such that the first axis X of the elongate member support 13 is substantially parallel with the longitudinal axes of the lengths of drill rods 21 stored in the storage zone 23. The elongate member support is then caused to rotate about the first axis X such that the elongate extension 17 closely overlies the lengths of drill rods in the storage zone.

The engagement means 19 is then caused to move longitudinally along the elongate extension 17 towards the outer end of the elongate extension 17 and the further clamp of the engagement means 19 is activated to become engaged with a length of drill rod 21.

Figure 2:
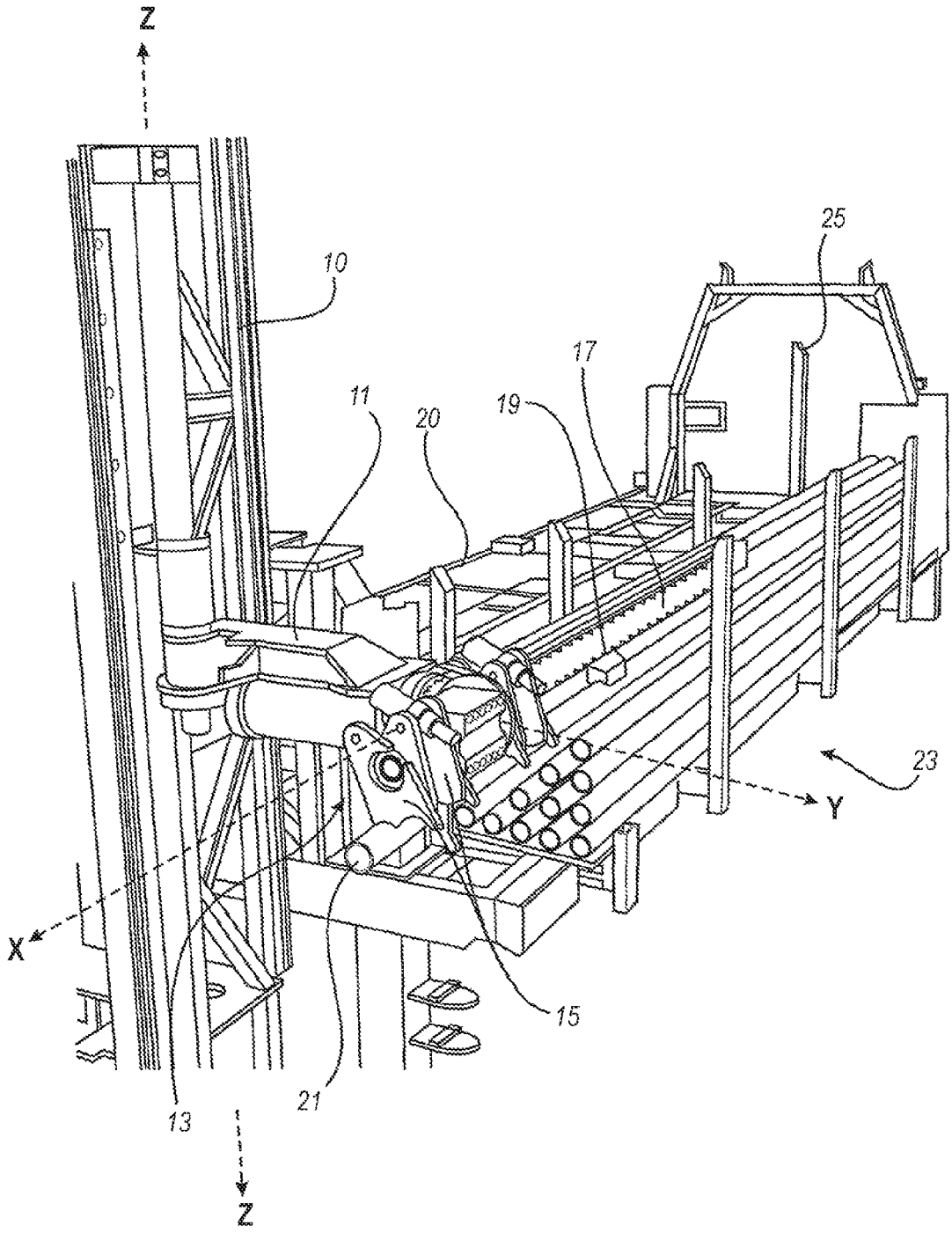
FIG. 2 is an isometric view corresponding to FIG. 1 showing the engagement means in its movement along the elongate member support.
Figure 3:
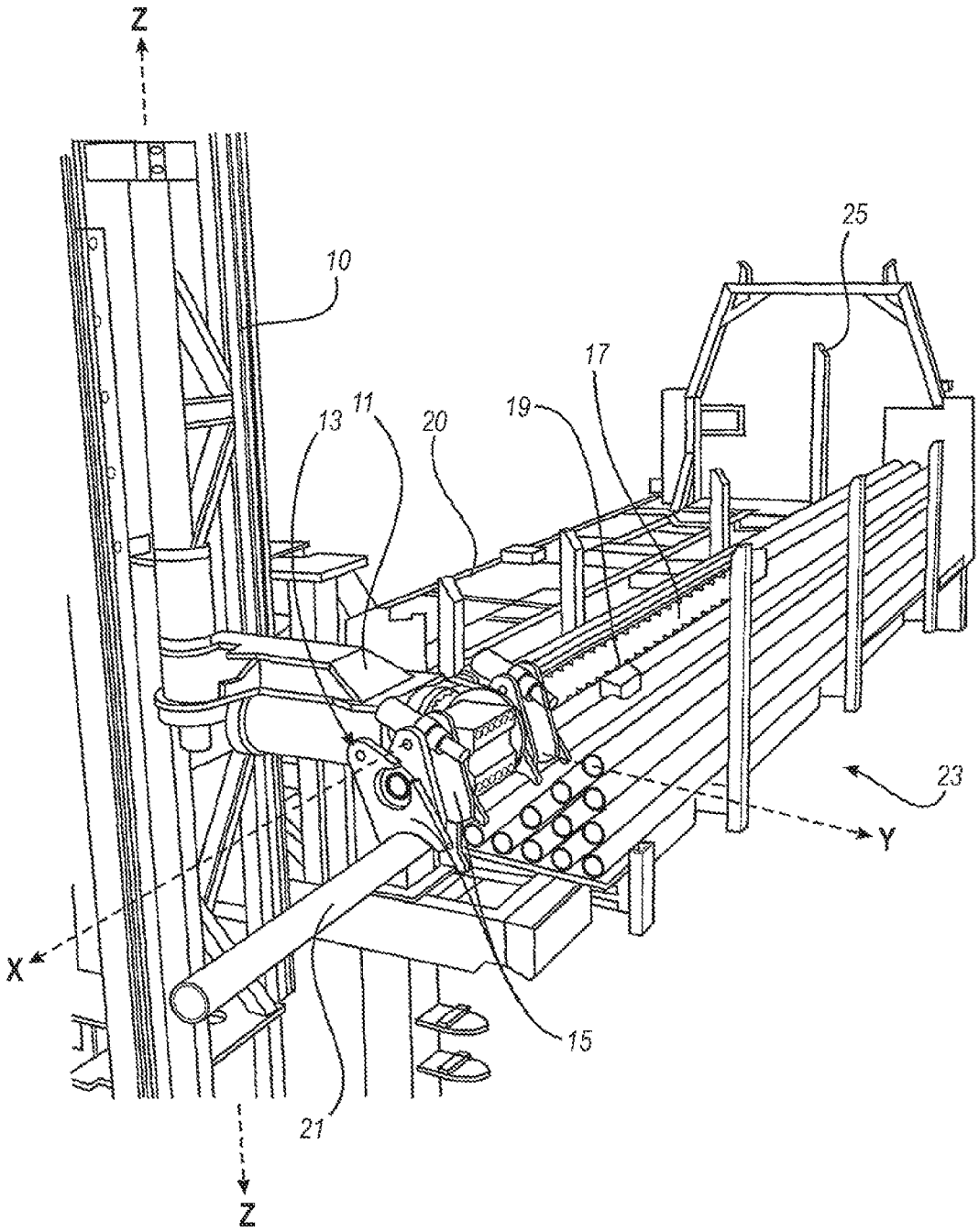
FIG. 3 is an isometric view corresponding to FIGS. 1 and 2 showing the length of drill rod in its final position on the elongate member support.

The engagement member 19 is then moved longitudinally along the longitudinal extension 17 in the direction of the elongate member support 13, as shown at FIGS. 2 and 3, such that the length of drill rod 21 enters into engagement with the disengaged clamping elements of the clamps 15. Once the length of drill rod 21 is located at the desired position in the elongate member support 13, the clamps 15 are then clampingly engaged with the length of drill rod 21 as shown at FIG. 3.

Figure 4:
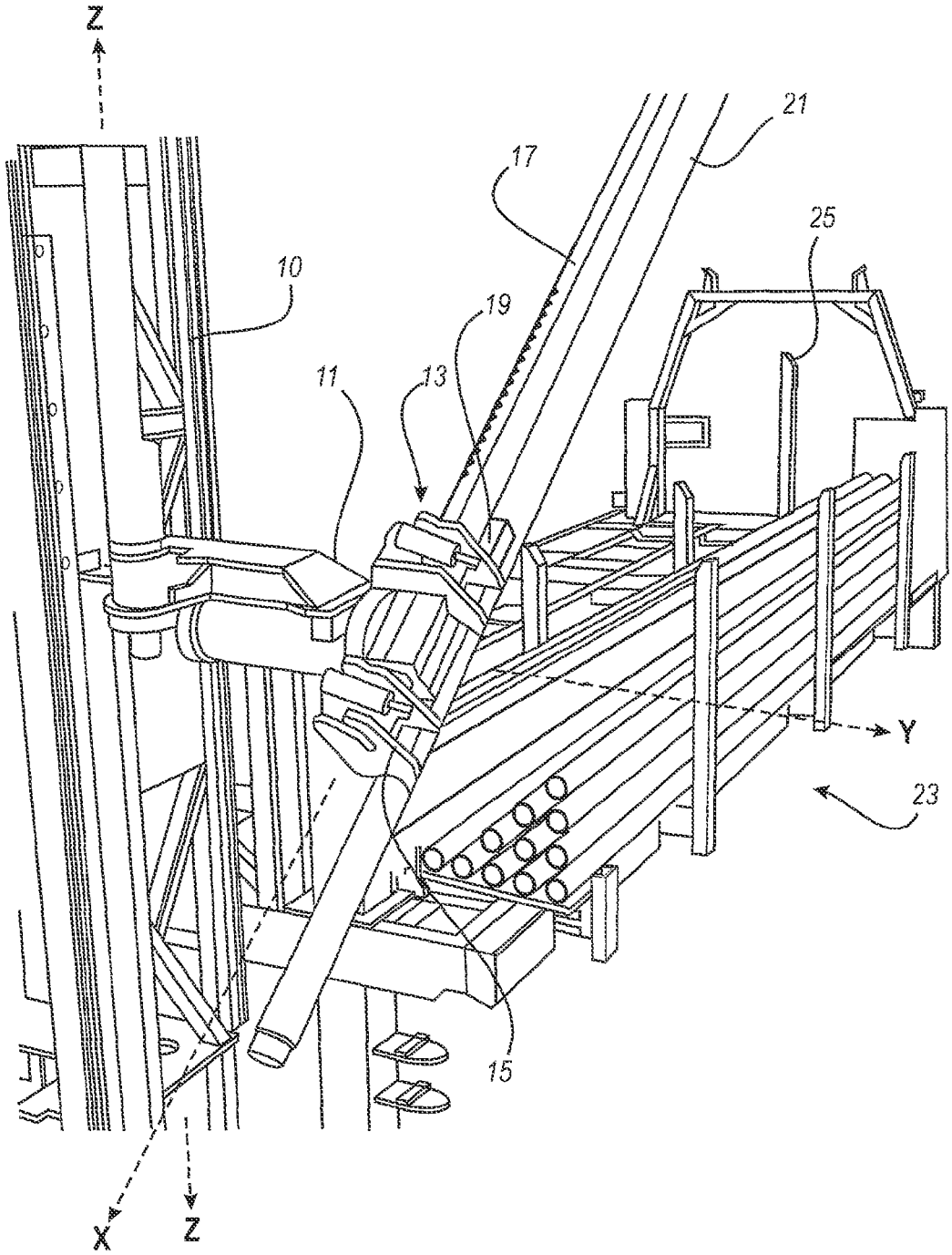
FIG. 4 is an isometric view corresponding to the previous drawings illustrating the rod being raised from the storage bin.

Once the length of drill rod 21 is engaged by the elongate member support 13, it is caused to rotate about the second axis Y to cause the length of drill rod 21 to be lifted from its substantially parallel position within the storage zone 23 as shown at FIG. 4. Then, it is ultimately moved to an erect position as shown at FIG. 5 at which it is located in a substantially upright position beside the mast 10 and substantially parallel to the mast 10.

Figure 5:
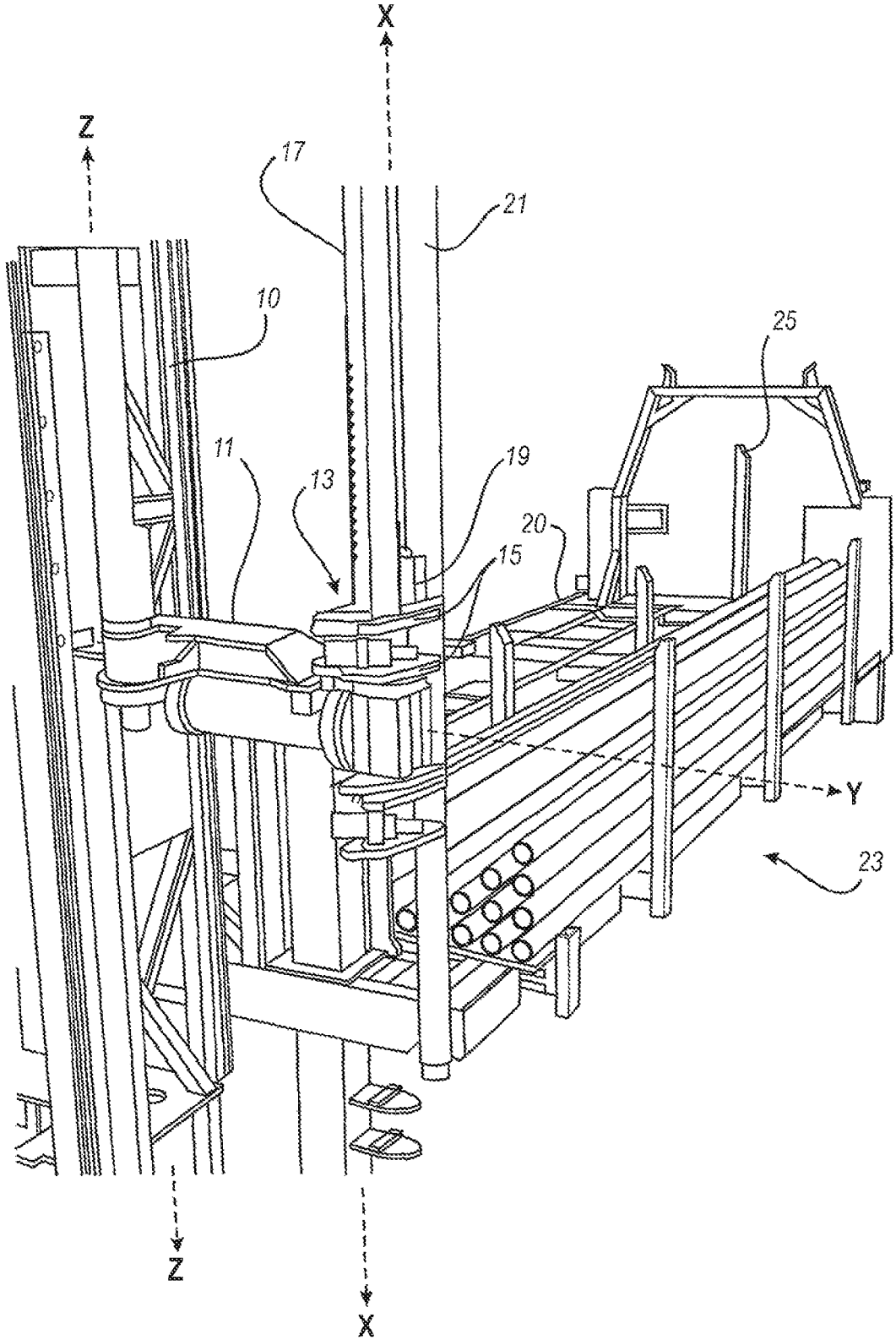
FIG. 5 is an isometric view corresponding to the previous illustrations illustrating the length of drill rod when raised to its erect position.
Figure 6:
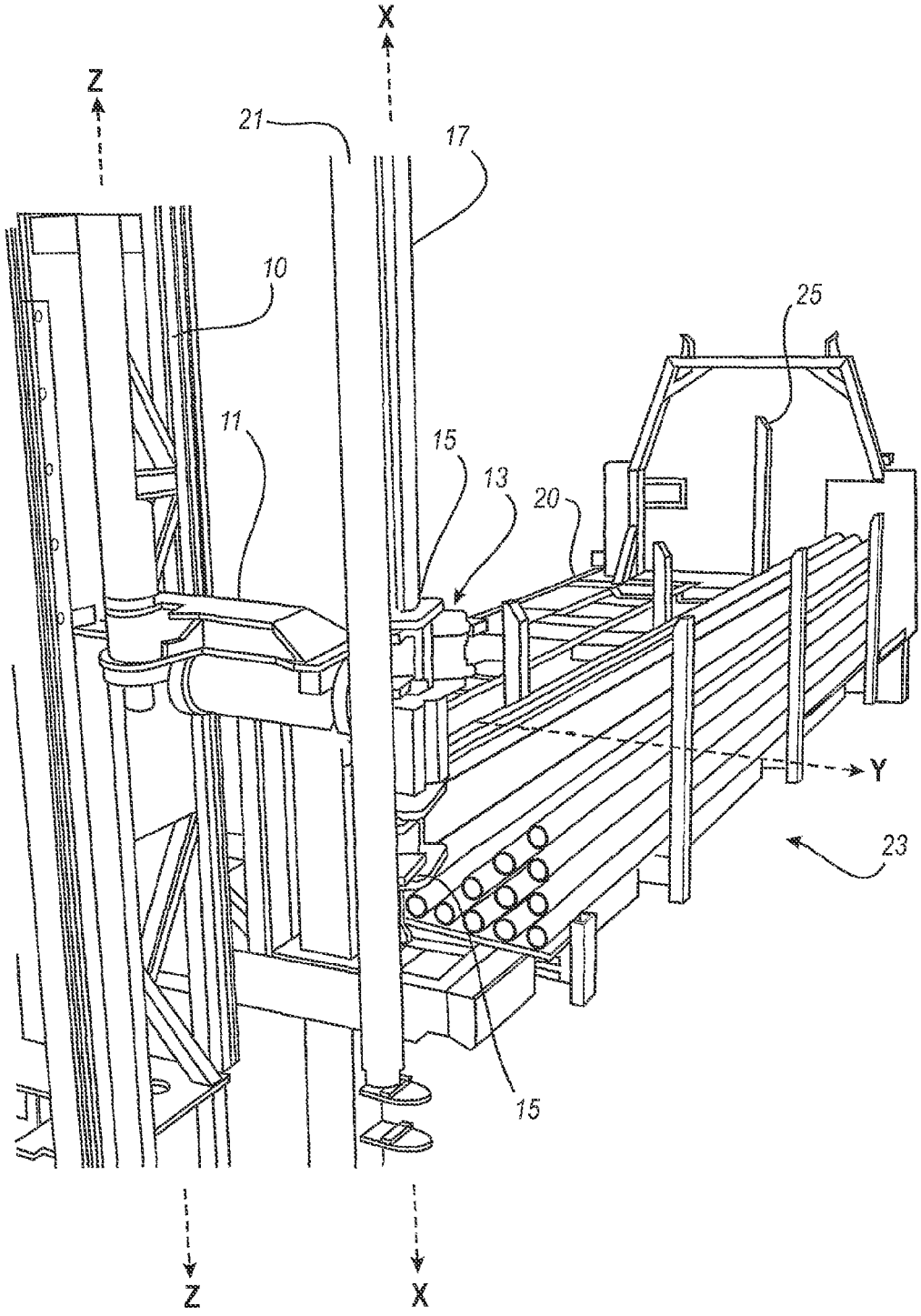
FIG. 6 is an isometric view illustrating the elongate member support having being pivoted about the radial arm about the second axis.

As depicted in the different positions in FIGS. 5 and 6, the elongate member support 13 (and the retained drill rod) is then caused to rotate on the radial arm 11 about the first axis X. Because of the transverse displacement of the first axis X from the central axis of the length of drill rod 21, the length of drill rod 21 is caused to rotate about the one end of the radial arm 11 to be located at a position at which can be readily located in alignment with the drill string.

Figure 7:
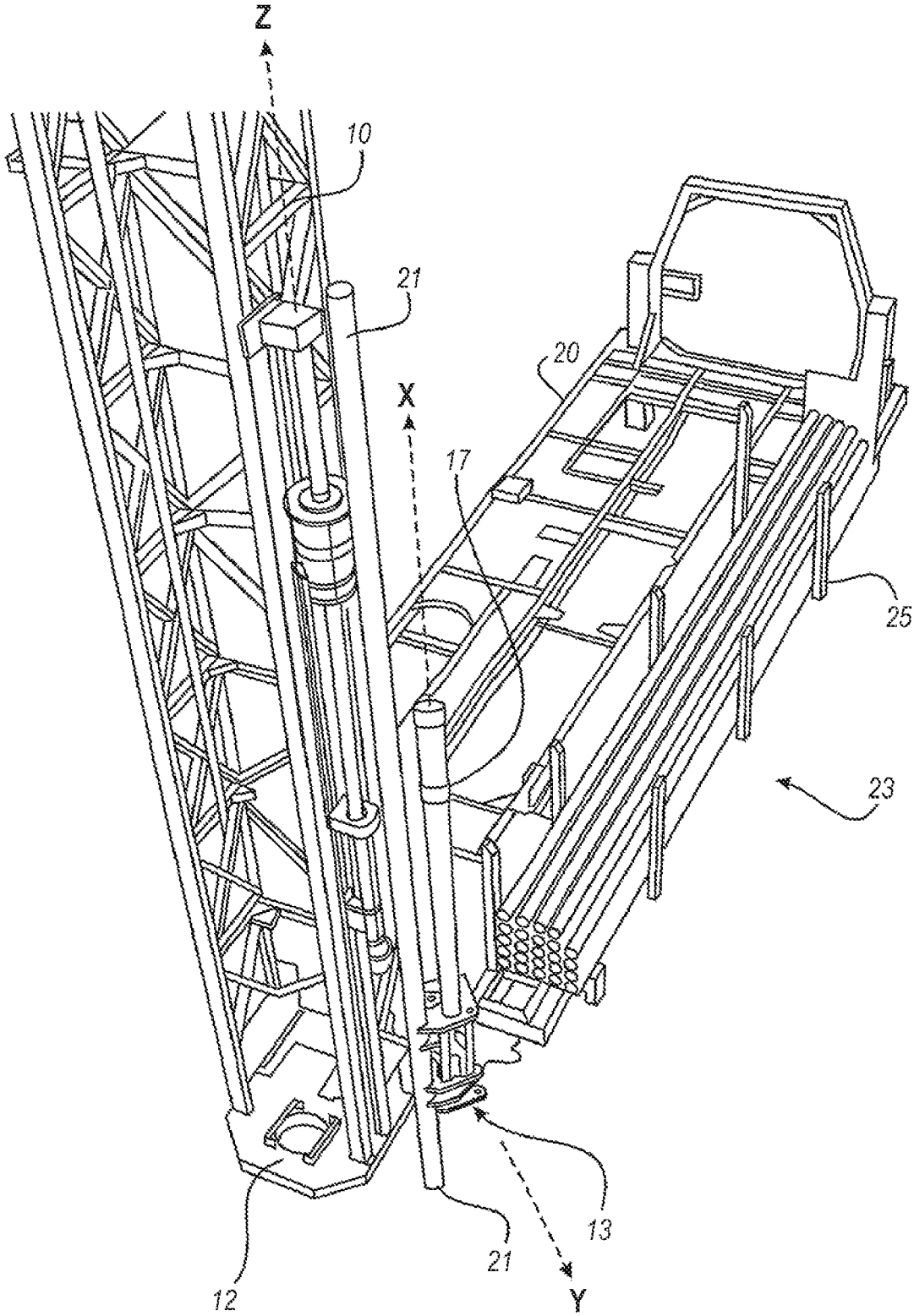
FIG. 7 is an upper isometric view of the first embodiment illustrating the radial arm at an intermediate position between its loading positions and its final position.

The radial arm 11 is then caused to rotate about the third axis Y as shown at FIGS. 7 and 8 to bring the length of drill rod 21 into alignment with the drill string. At this final position the drive head (not shown) of the drill rig can be engaged with the upper end of the length of drill rod 21 to enable it to be engaged with a drill string that is located in the bottom of the mast. In the engagement of the length of drill rod 21 with the drill string, the clamping engagement by the clamps 15 may be loosened to allow the length of drill rod 21 to move slidably through the clamping members 15 while still restrained thereby such that it will maintain the alignment of the length of drill rod 21 on its movement into an engagement with the drill string.

In order to remove a length of drill rod 21 from a drill string the radial arm 11 is initially caused to rotate on the mast 10 about the third axis Z until the clamp 15 is in engagement with the length of drill rod. The clamps are then engaged with the length of drill rod. The radial arm 11 is then cause to rotate on the mast 10 about the third axis Z to bring the outer end of the radial arm proximate the storage zone 23.

The elongate member support 13 is caused to rotate on the radial arm 11 about the first axis X such that the length of drill rod supported thereby is located most proximate the storage zone 23. The elongate member support 13 is then caused to rotate on the radial arm 11 about the second axis Y until the length of drill rod is located above and parallel to the lengths of drill rod already accommodated within the storage zone.

The engagement member 19 is then moved along the extension member 17 and the further clamp thereof is engaged with the length of drill rod while the clamp 15 is disengaged therefrom. With movement of the engagement member 19 along to the extension member 17 away from the radial arm the length of drill rod is located directly above the lengths of drill rod accommodated in the storage zone and on release from the further clamp the length of drill rod is deposited into the storage zone 23.

It should be appreciated that it is a feature of the present invention that the storage zone 23 can be accommodated upon a truck body 20, trailer or a like vehicle which can be located at any position within the range of the 270° movement of the radial arm on the mast 10.

The present invention is not to be limited in scope by the specific embodiment described herein. The embodiment is intended for the purpose of exemplification only. Functionally equivalent features and methods are clearly within the scope of the invention as described herein.

The claims defining the invention is as follows:

1. A drilling system comprising a drilling mast which is to be associated with drill string located in a bore hole and a drill rod handling device which in use is intended to be mounted adjacent the drilling mast, the drill rod handling device comprising:

a base adapted to be supported from the drill rig;

a movable clamp coupled to the base, the moveable clamp being configured to grasp a drill rod from a first, storage position with a first orientation;

a first drive for rotating the moveable clamp about a first axis that is parallel and offset from the drill rod when grasped in the moveable clamp;

a second drive for rotating the moveable clamp about a second axis to move the drill rod from the first orientation toward a vertical orientation and into a second orientation;

a third drive for rotating the moveable clamp about a third axis to move the drill rod into a second, drilling position while maintaining the drill rod in the second orientation, the third axis being parallel and offset from the drill rod when in the second orientation, wherein when the drill rod is in the second orientation the third axis is parallel and offset from the first axis and when the drill rod is in the first orientation the third axis is transverse to the first axis.

2. A drilling system as recited in claim 1, further comprising:

an elongate member extending from the movable clamp; and an engagement member coupled to the elongate member, the engagement member being adapted to grasp the drill rod.

3. A drilling system as recited in claim 2, wherein the elongate member support further comprises an elongate extension, the engagement member being mounted to the elongate extension to be movable along the elongate extension.

4. A drilling system as recited in claim 3, wherein the engagement member includes a clamping mechanism to enable the engagement member to clampingly engage the drill rod.

5. A drilling system as recited in claim 1, wherein the elongate member support is rotatable on the base about the first axis and wherein a central axis of the length of drill rod when engaged by the elongate member support is spaced from the first axis.

6. A drilling system as recited in claim 1, wherein the base comprises a radial arm which supports the moveable clamp towards one end and which adapted to be supported at its other end on the drill rig.

7. A drilling system as recited in claim 6, wherein the drill rod handling device is adapted to grasp a drill rod from any storage position within a 270 degree range of motion relative to the radial arm and move the drill rod into the drilling position.

8. A drilling system as recited in claim 6, wherein the base is moveably coupled to the drill rig.

9. A drilling system as recited in claim 6, wherein the first drive is adapted to rotate the moveable clamp independently from the radial arm.

10. A drilling system as recited in claim 6, wherein the third drive is adapted to rotate the radial arm and the moveable clamp together about the third axis.

11. A drilling system as recited in claim 1, wherein the third drive is adapted to rotate the moveable clamp and the drill rod grasped therein within a 270 degree range of motion about the second axis.

12. A drilling system as recited in claim 1, wherein the second axis is a horizontal axis.

13. A method of installing lengths of a drill rod into a drill string associated with a drilling mast comprising:

grasping a drill rod within a moveable clamp when the drill rod is in a first orientation, wherein the drill rod is capable of rotation about a first axis that is parallel and offset from the drill rod when in the first orientation;

rotating the drill rod about a second axis into a second orientation parallel to the drilling mast, wherein the second axis is transverse to the first axis;

rotating the drill rod about the first axis that is parallel and offset from the drill rod when grasped in the moveable clamp; and rotating the drill rod about a third axis and into a drilling position above the drill string, wherein when the drill rod is in the second orientation the third axis is parallel and offset from the first axis and when the drill rod is in the first orientation the third axis is transverse to the first axis.

14. The method as recited in claim 13, further comprising attaching the drill rod to the drill string.

15. The method as recited in claim 13, further comprising moving the drill rod axially from a storage zone prior to grasping the drill rod with the moveable clamp.

16. The method as recited in claim 15, wherein moving the drill rod axially comprises:

engaging the drill rod with an engagement member positioned on an elongate extension coupled to the moveable clamp; and moving the engagement member along the elongate extension to move the drill rod axially toward the moveable clamp.

17. The method as recited in claim 13, further comprising moving the drill rod vertically by translating the moveable clamp along the drilling mast.

18. The method as recited in claim 13, wherein:

the moveable clamp is coupled to a first end of a radial arm; and the second, opposing end of the radial arm is coupled to a base positioned on the drilling rig.

19. The method as recited in claim 18, wherein rotating the drill rod about a first axis that is parallel and offset from the drill rod when grasped in the moveable clamp comprises rotating the drill rod independently from the radial arm.

20. The method as recited in claim 19, wherein rotating the drill rod about the drilling mast and into a drilling position above the drill string comprises rotating the drill rod and the radial arm together about the drilling mast.

21. The method as recited in claim 13, wherein the second axis is a horizontal axis.

22. A method of removing a length of drill rod from a drill string associated with a drilling mast comprising:

grasping a drill rod in a drilling position having a first orientation using a movable clamp positioned at an end of a radial arm coupled to the drilling mast;

rotating the radial arm, the moveable clamp, and the grasped drill rod about a first axis to move the drill rod out of the drilling position;

rotating the moveable clamp and the grasped drill rod independent from the radial arm about a second axis that is parallel and offset from the drill rod when grasped in the moveable clamp;

rotating the moveable clamp and the grasped drill rod about a third axis to move the drill rod into a storage orientation, wherein when the drill rod is in the first orientation that first axis is parallel and offset from the second axis and when the drill rod is in the storage orientation that second axis is transverse to the first axis; and releasing the drill rod from the moveable clamp.

23. The method as recited in claim 22, wherein the third axis is a horizontal axis.

* * * * *